US005921480A

United States Patent [19]

Wenzel

[11] Patent Number: 5,921,480

[45] Date of Patent: Jul. 13, 1999

[54] GRINDING MACHINE AND METHOD

[75] Inventor: Reiner Wenzel, Coorparoo, Australia

[73] Assignee: Grindtech Investments, Los Angeles, Calif.

[21] Appl. No.: 09/048,638

[22] Filed: Mar. 26, 1998

[51] Int. Cl.[6] ..... B02C 7/02

[52] U.S. Cl. ..... 241/29; 241/82.4; 241/163; 241/186.5; 241/DIG. 31

[58] Field of Search ..... 241/82.4, 29, 163, 241/247, DIG. 31, 186.5, 27

[56] References Cited

U.S. PATENT DOCUMENTS

| | | | |
|---|---|---|---|
| 959,714 | 5/1910 | Carlson | 241/82.2 |
| 2,166,197 | 7/1939 | Schaub | 241/82.4 |
| 4,003,521 | 1/1977 | Hess | 241/82.4 |
| 4,614,308 | 9/1986 | Barclay | 241/154 |
| 5,100,069 | 3/1992 | Barclay | 241/236 |
| 5,289,978 | 3/1994 | Lundquist | 241/57 |

*Primary Examiner*—John M. Husar
*Attorney, Agent, or Firm*—Fulbright & Jaworski

[57] ABSTRACT

The present invention provides an industrial grinding machine and method of grinding by shredding between stationary cutters and rotating cutters placed within a plurality of cutting units, each cutting unit having a blunt stationary cutter and a blunt rotating cutter, which are spaced apart, without the use of sharpened knife blades.

18 Claims, 9 Drawing Sheets

34
48
82
48
48
34

44
44

28
28

FIG. 9A
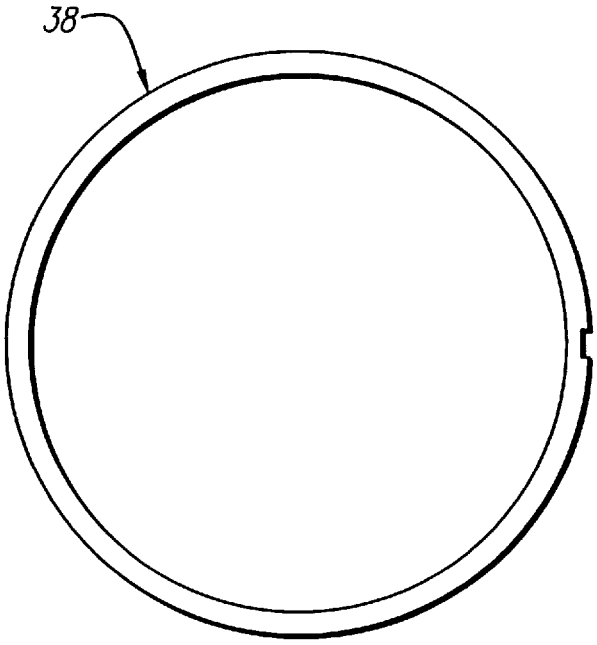
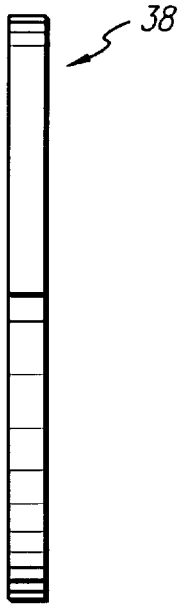
FIG. 9B
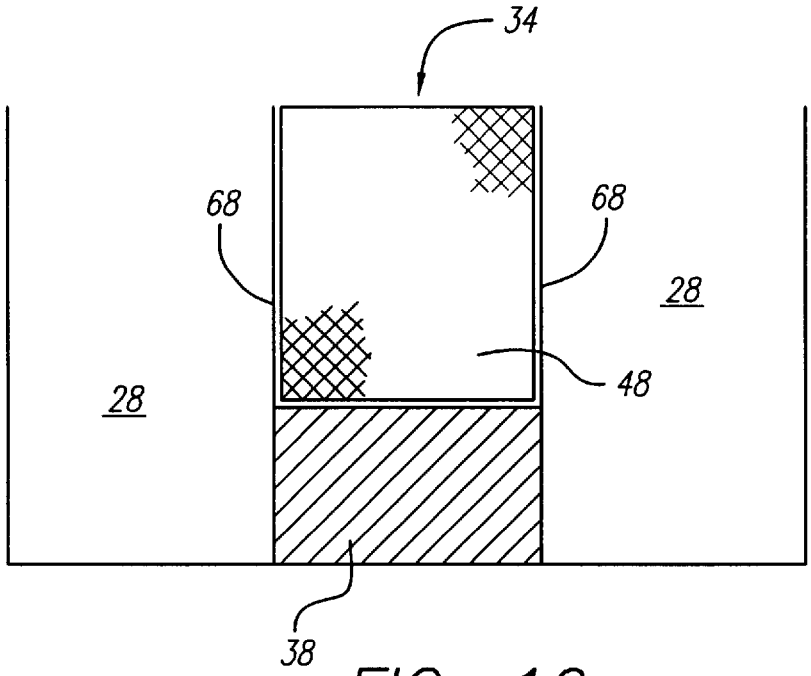
FIG. 10

GRINDING MACHINE AND METHOD

TECHNICAL FIELD OF THE INVENTION

The present invention relates generally to the field of industrial grinding machines. In particular, the invention relates to grinding machines and method of grinding with a plurality of cutting units, each cutting unit having a stationary and a blunt rotating cutter, which are spaced apart.

BACKGROUND OF THE INVENTION

Conventional industrial grinding machines used for rubber recycling and other grinding purposes are large and cumbersome, have low output volume and use excessive energy. Currently used "cracker mill" machines use two rollers operating side-by-side with minimal clearance between them, one rolling at a faster speed than the other, either by adjusting the revolutions per minute or by using rollers of differing diameters. The friction caused by the difference in speed causes the rubber or other material to break. Yet other machines use blades with knife edges to cut the material into small pieces.

SUMMARY OF THE INVENTION

In a first aspect, the present invention includes a grinding/granulating device for reducing deformable material into smaller units, said device comprising a processing chamber for reducing said material into smaller units, the chamber having an inside wall with an intake side with an intake opening, and an exit side with an exit opening; a rotating shaft passing through said processing chamber and connected to a motor means for rotating said shaft; one or more stacked cutting units arranged along the grinding chamber, each cutting unit comprising: at least one stationary cutter extending from the inside wall of the processing chamber, having at least one cutting tooth and defining an aperture cavity through which the rotating shaft passes; at least one rotating cutter, fixedly attached to the rotating shaft and rotating with said shaft, having at least one cutting tooth, said cutting tooth rotating adjacent to said at least one cutting tooth of the stationary cutter, to impact, stretch and sheer off quantities of said material; and means for urging material to be ground from said intake opening to said plurality of cutting units; wherein the material is reduced by the action of the rotating cutter rotating in proximity to the fixed cutter. In other aspects the present invention also includes a stationary cutter having a flat cutting surface; a rotating cutter having a flat cutting surface; a rotating cutter having three teeth; a stationary cutter has three teeth; a rotating cutter located proximate to the intake side of the grinding chamber, and having at least three teeth, and comprising a second rotating cutter, located proximate to the exit side of the grinding chamber and distant from the intake side, said second rotating cutter having more than three teeth; a second rotating cutter having six teeth; a stacked cutting unit comprising one rotating cutter and two stationary cutters; a stacked cutting unit comprising one stationary cutter and two rotating cutters; means for urging material to be ground from the intake opening to the plurality of cutting units further comprises an intake auger; and a discharge auger for moving ground material particles to the exit opening.

In yet another aspect, the present invention includes cutting units comprising: a stationary annular spacer surrounding the rotating cutter and touching an adjacent stationary cutter, providing a gap between the stationary and the rotating cutter; and a central rotating spacer attached to the rotating shaft and adapted to fit inside the stationary cutter; wherein material is forced past the stationary and then the rotating cutter; a stationary cutter, rotating cutter, annular spacer and central rotating spacer made of the same material; and the annular spacer and said central rotating spacer are sized and positioned such that the material is confined between an outer surface of the central rotating spacer and an inner surface of said annular spacer.

In another aspect, the present invention provides a method for granulating/grinding elastic material comprising the following steps: cutting the elastic material into appropriately sized pieces; urging the pieces into a grinding chamber; positioning a second blade adjacent to a first blade; rotating the second blade relative to the first blade; moving the pieces past the first blade; and moving the pieces past the second blade, allowing the second blade to impact the material, stretch it and sheer off quantities of the material against the first blade. In a further aspect, the present invention includes a method comprising the additional steps of: positioning a fourth blade adjacent to a third blade; rotating the fourth blade relative to the third blade; after moving said pieces past the first and second blades, moving the pieces past the third blade; and moving the pieces past the fourth blade, allowing the fourth blade to impact the material, stretch it and sheer off quantities of the material against the third blade, creating a finer resulting product then produced by the first and second blades; and the additional steps of: moving the resulting sheered off pieces past additional sets of two adjacent blades, one rotating relative to the other, creating a progressively finer resulting product than produced by the first and second fixed and rotating blades.

BRIEF DESCRIPTION OF THE DRAWINGS

The features of the present invention can be best understood together with further objectives and advantages by reference to the following description, taken in connection with the accompanying drawings, wherein like numerals indicate like parts.

FIG. 9 is a top view and a side view of a annular ring spacer (38), suitable for use with the grinding machine of FIG. 1.

FIG. 10 is a side cutaway view of an annular ring spacer (38) and a rotating cutter (34), placed between two stationary cutters (28), in accordance with the present invention.

DETAILED DESCRIPTION OF THE INVENTION

In the following description, numerous specific details are set forth in order to provide a more thorough description of the invention. It will be apparent, however, that the present invention may be practiced without these specific details. In other instances, well known features have not been described in detail so as not to unnecessarily obscure the present invention.

Figure 1:
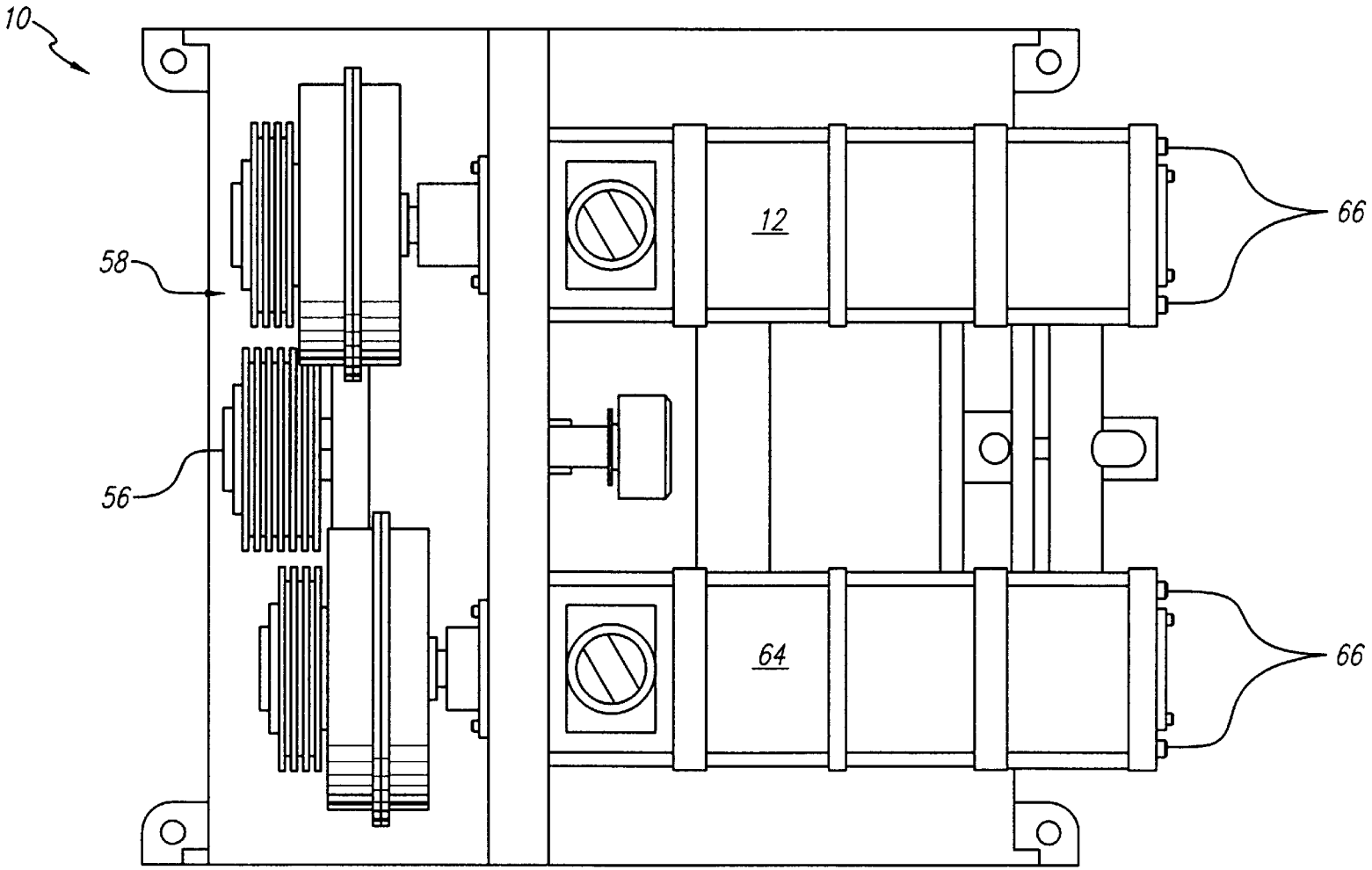
FIG. 1 is a top view of a grinding machine, showing the electric motor (56), reduction gear box and pulley mechanism (58) and two granulating and grinding units (12 and 64) in accordance with a preferred embodiment of the present invention.
Figure 2:
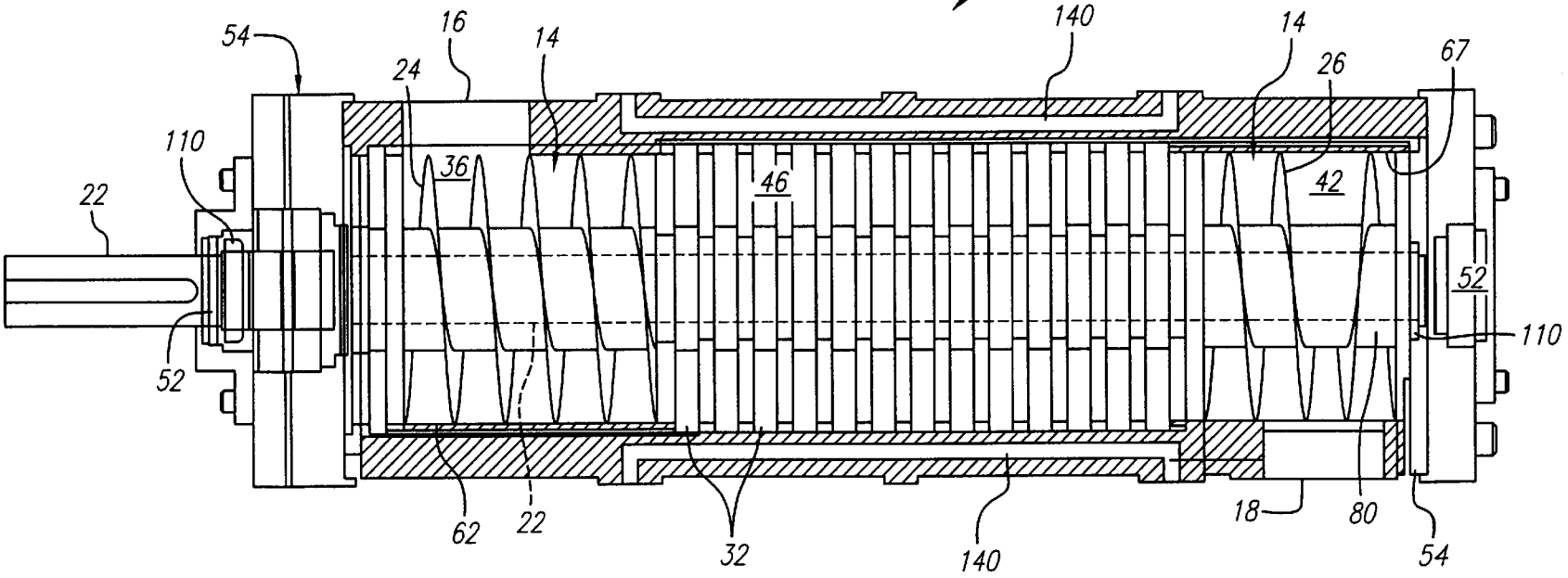
FIG. 2 is a side cutaway view of the interior of a granulating and grinding unit (12) of FIG. 1.

In accordance with one embodiment of the present invention, FIG. 1 shows a granulating/grinding machine 10 which includes one or more grinding units, such as granulating and grinding unit 12. Referring to FIG. 2, the granulating and grinding unit 12 has a rotating shaft 22 passing through lengthwise and includes an intake section 36 having an intake opening 16, an intake auger 24 coupled to the rotating shaft 22, for urging the material particles entering through the intake opening 16 into a processing section 46 of the granulating/grinding chamber 14, an optional discharge auger 26 in a discharge section 42 of the granulating/grinding chamber 14 for moving the pulverized material particles to an exit opening 18, and a plurality of cutting units, such as cutting unit 32 (see also FIG. 6), in the processing section 46.

Figure 6:
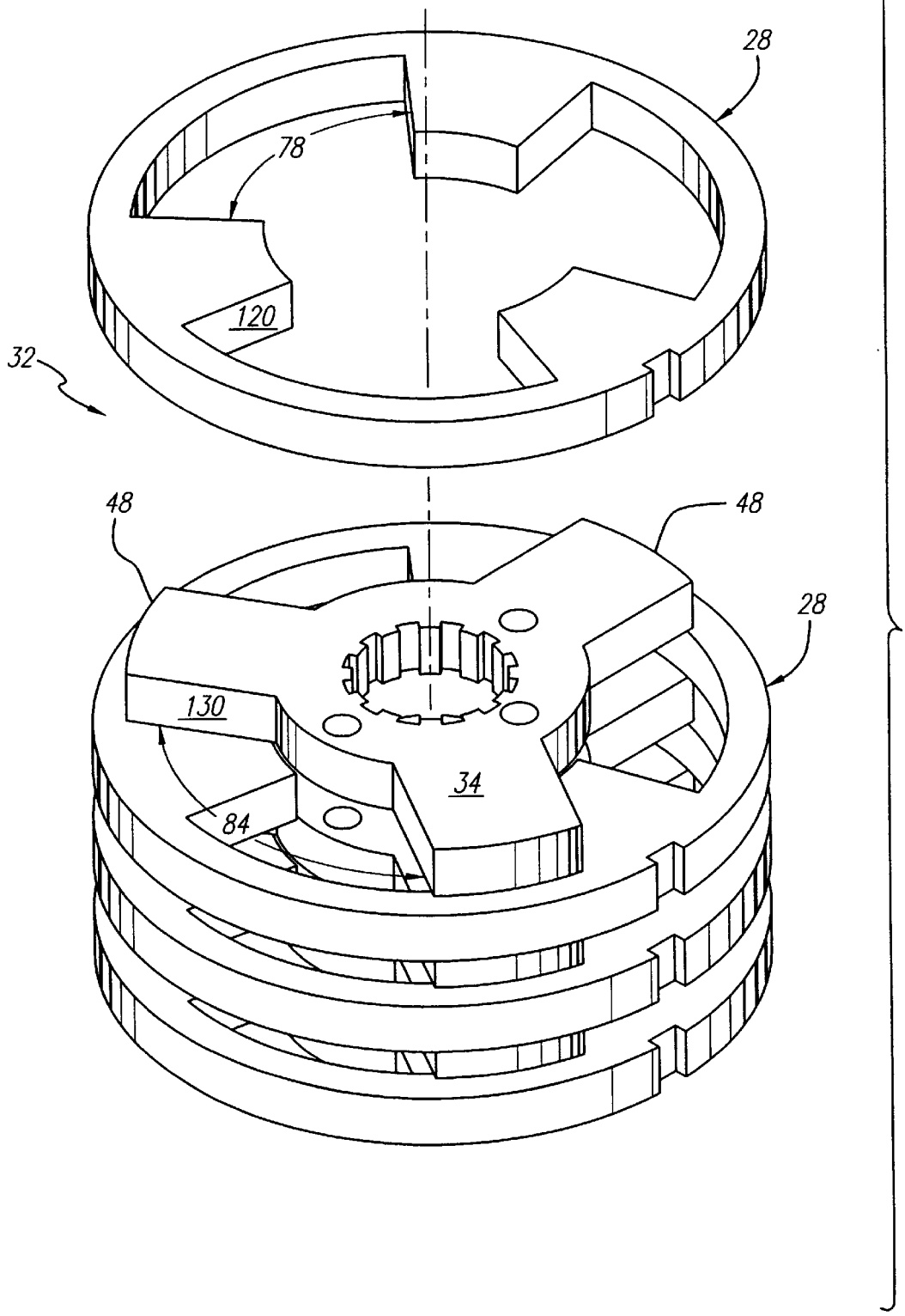
FIG. 6 is an isometric view of a group of cutting units (32) of a preferred embodiment of the present invention, each unit consisting of a stationary cutter (28) and a rotating cutter (34).

As is illustrated in FIG. 6 viewed along side FIGS. 3–5, 7 and 9, each cutting unit 32 has a stationary cutter 28 attached to the inside wall of the granulating and grinding unit 12 (which is also the wall of the granulating/grinding chamber 14), the stationary cutter 28 defining an aperture cavity through which the rotating shaft 22 passes, a rotating cutter 34, fixedly attached to and around the rotating shaft 22, a stationary annular ring spacer 38 (FIGS. 9 and 10) encircling the rotating cutter 34 and providing a gap between the stationary cutter 28 and the rotating cutter 34, and a central rotating spacer 44 (FIG. 5) attached to the rotating shaft 22 and made to fit the inside of the stationary cutter 28. In each cutting unit 32 the stationary cutter 28 and the rotating cutter 34 are spaced apart by the ring spacer 38. The gap 68 between the stationary cutter 28 and the rotating cutter 34 varies with different applications, but in a preferred embodiment, designed for grinding pieces of tires, the gap is approximately 0.25 mm.

The rotating cutters 34 of the cutting units 32 located near the "forward end" of the granulating and grinding unit 12 (the end of the processing section 46 near the intake section 36) have three teeth 48 (FIG. 4) for coarse grinding. Fine grind rotating cutters 86 are also provided, located rearward of the "coarse" rotating cutters 34, and have six teeth, which may be identical to the teeth 48 of the rotating cutters 36, or in a preferred embodiment, beveled teeth 70 (FIG. 7) may be provided (described more fully below). This preferred embodiment facilitates coarser grinding at the beginning of the process, and then finer grinding. The ratio of rotating cutters 34 to fine grind rotating cutters 86 and positioning of same may be varied depending upon the specific needs and applications of the user. With regard to grinding pieces of tires, it has been found that three cutting units 32 (which include rotating cutters 34 having three regular teeth 48), followed by eight cutting units 32 (which include fine grind rotating cutters 86 having six regular teeth 48), followed by one or two cutting units 32 (which include fine grind rotating cutters 86 having six beveled teeth 70, as discussed below), yields very satisfactory results. The orientation of the stationary cutters 28 as well as the rotating cutters (34 and 86), relative to each other, may be varied to prevent a hole from passing directly through the granulating/grinding chamber 14. It should be understood in applying the present invention to differing uses, that the numbers and styles of teeth, as well as the arrangement of cutting units, will vary.

Figure 8:
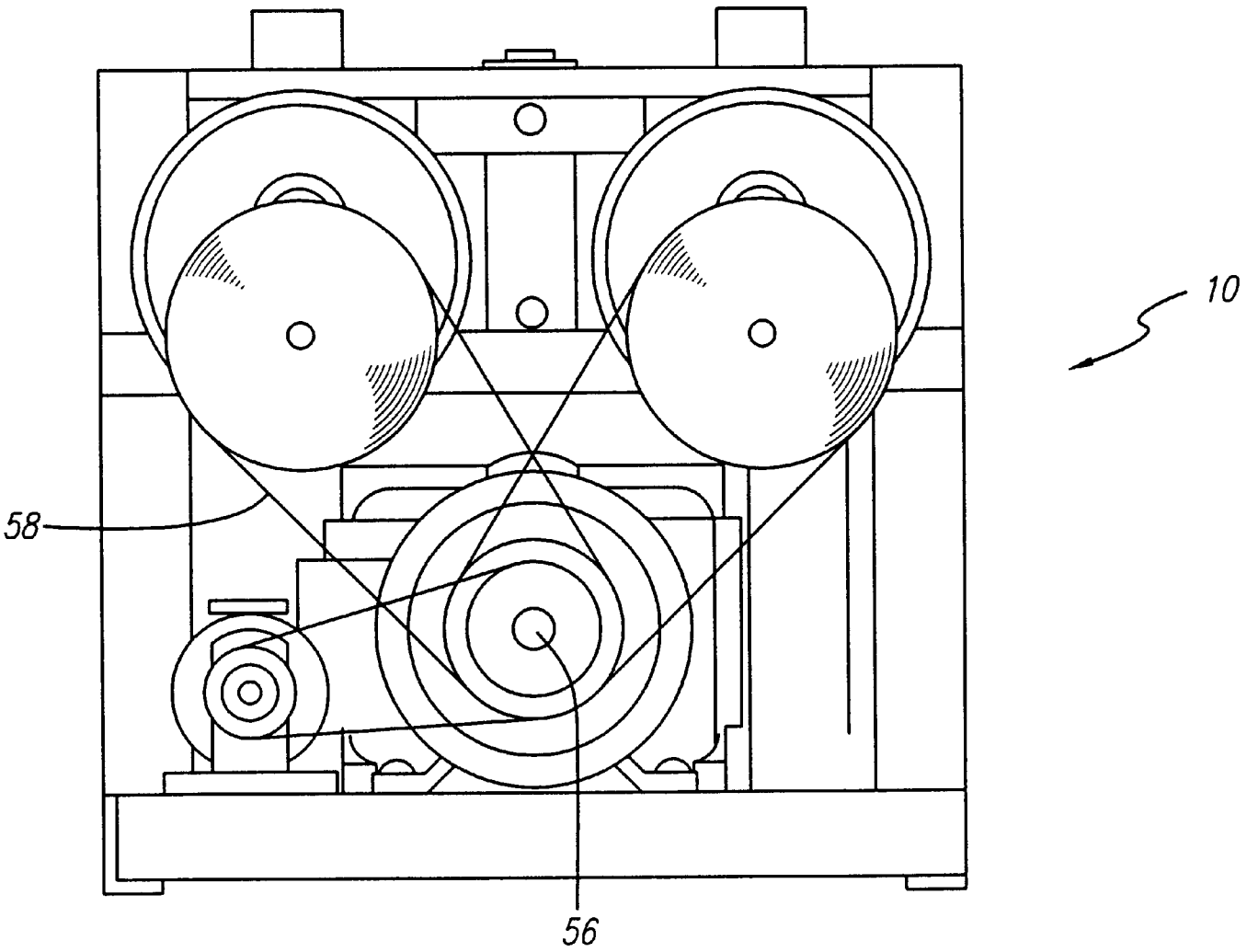
FIG. 8 is a front elevational view of the grinding machine of FIG. 1, showing the electric motor (56) and reduction gear box and pulley mechanism (58).

Referring to FIG. 2, at the end of the intake auger 24 distant from the processing section 46 there is a seal assembly 52, which supports the rotating shaft 22, and through which the rotating shaft 22 passes out of the granulating/grinding chamber 14. The gear box and pulley mechanism 58 engages and transmits rotational movement to the rotating shaft 22. At the end of the discharge auger 26 distant from the processing section 46 there is a bearing housing 54 bolted onto the granulating/grinding chamber 14, and a seal assembly 52 which holds the rotating shaft 22 in its proper position in the center of the granulating/grinding chamber 14. Referring to FIGS. 1, 2 and 8, the rotating shaft 22 is preferably driven by an electric motor 56 via a reduction gear box and pulley mechanism 58, although many other types of motors and gearing mechanisms can be used. The intake and the discharge sections (36 and 42) of the granulating/grinding chamber 14 are preferably fitted with wear protection sleeves 62 which must be held securely inside these portions of the granulating/grinding chamber 14, and are affixed in position with a steel key (not shown) to prevent turning. The wear protection sleeves 62 are ideally replaceable so that the passage and processing of rubber or other materials through one of the granulating and grinding units, such as granulating and grinding unit 12, causes wear and tear to the wear protection sleeve 62, and not to the granulating and grinding unit 12. Each wear protection sleeve 62 has an opening which matches the appropriate granulating/grinding chamber 14 opening, i.e., intake opening 16 and exit opening 18.

Figures 3A, 3B, 4B, 5A, 5B:
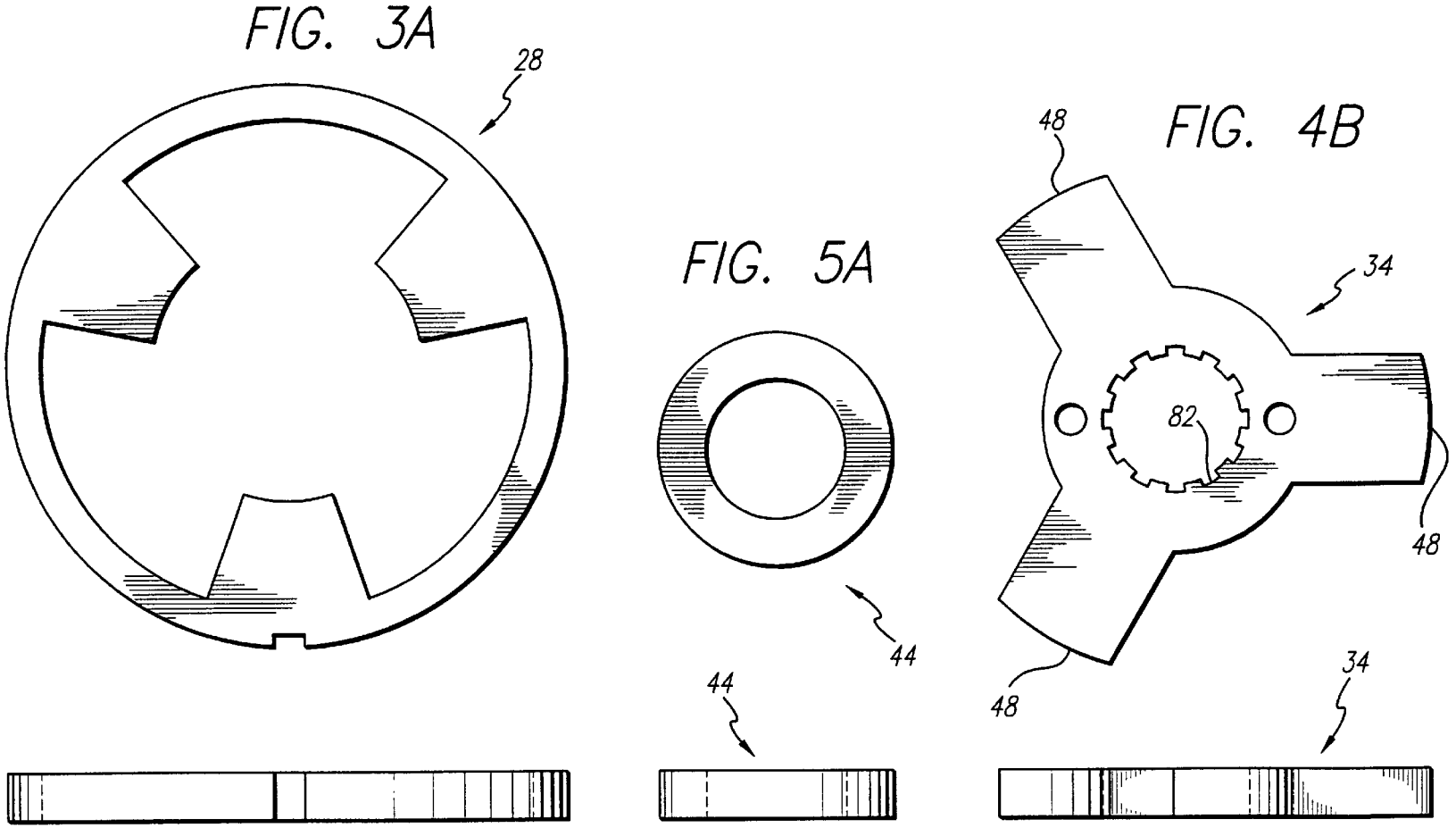
FIG. 3 is a top view and a side view of a stationary cutter (28) of a preferred embodiment of the present invention.
FIG. 4 is a top view and a side view of a rotating cutter (34) of a preferred embodiment of the present invention.
FIG. 5 is a top view and a side view of a central rotating spacer (44) of a preferred embodiment of the present invention.
Figure 7C:
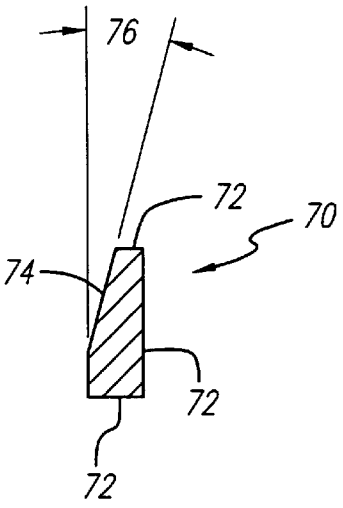
FIG. 7 is a top view and a side elevational view of a fine grind rotating cutter (86) of a preferred embodiment of the present invention, showing beveled teeth (70), for use either in a rotating cutter (34) or a fine grind rotating cutter (86), having a slanted surface (74).
Figure 7A:
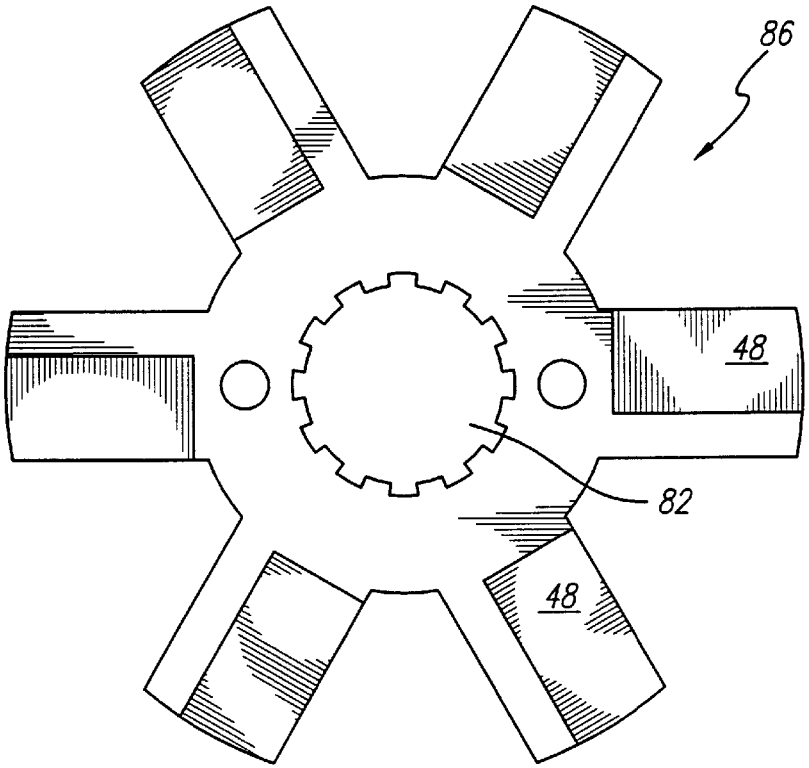
Figure 7B:
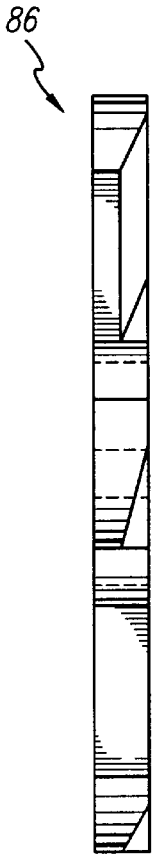

Material can enter through an optional inlet manifold (not shown) attachable to the intake opening 16 of the granulating/grinding chamber 14. The various parts of the granulating and grinding unit 12 can be held in position by any number of commercially available mechanisms, such as lock nuts 110, or other similar devices. For example, a lock nut (not shown) can secure the rotating cutter to the rotating shaft 22. Structural rigidity is assured by the serrated surface 80 of the rotating shaft 22 (FIG. 2) meshing with the center indentations 82 of the rotating cutters 34 and 86 (FIGS. 4 and 7). Similarly, the sections (36, 42 and 46) of the granulating/grinding chamber 14 can be held together in any number of ways, such as clamping them together by tie rods, like tie rods 66 (FIG. 1) or alternatively, bolts (not shown). Typically, the stationary cutters 28 and the rotating cutters 34 have diameters measuring between 10 cm and 40 cm, depending upon the size of the granulating/grinding chamber 14. In a preferred embodiment, the stationary cutters 28 each have an outside diameter of about 305 mm, and the rotating cutters 34 (and 86) have an outside diameter of about 268 mm. The granulating/grinding machine 10 may have as few as one or as many as five or more grinding units (also called barrels), like grinding unit 12. An embodiment with two "barrels" (granulating and grinding unit 12 and second granulating and grinding unit 64) is shown in FIG. 1. The "barrels" may be positioned in a number of ways, such as parallel, sidewise, or above each other. In addition, the granulating/grinding machine 10 itself may be oriented horizontally, vertically or in other positions without affecting functionality. When a vertical orientation is employed, gravity may be used, rather than intake auger 24 and discharge auger 26, to move the material into and out of the processing section 46 of the granulating/grinding chamber 14.

The granulating/grinding machine 10 of the present invention can process any number of materials, such as wood, food, plastics, pathology waste, and the like. However, the granulating/grinding machine 10 of the present invention has been found to be quite useful with materials having some elastomeric properties, such as rubber. Typically, such material consists of rubber tires, previously shredded or cut into pieces smaller than two inches in the longest dimension.

As seen in FIG. 2, with the granulating/grinding machine 10 in operation, the material to be processed is fed into the intake section 36 of the granulating/grinding chamber 14 through the intake opening 16, and then urged into the processing section 46 by the intake auger 24. The rotation of the intake auger 24 pressurizes the processing section 46 as it pushes the material into the processing section 46. As noted above, any number of cutting units 32 can be employed, depending upon such factors as the kind of material to be processed and the fineness of the desired grind. For simplicities sake, only one such cutting unit 32 need be discussed in detail. As the material is urged past the stationary cutter 28, small amounts pass through a gap 68, shown in FIG. 10, between the stationary cutter 28 and the rotating cutter 34.

Referring to FIG. 6, each rotating cutter 34 of the present invention passes over the front of a corresponding stationary cutter 28 and the material particles are positioned between the leading faces (120 and 130) of the cutters 28 and 34. Rubber tends to adhere to the leading face 120 and other surfaces of the stationary cutter 28, while at the same time being urged away from the leading face 120 of the stationary cutter 28 by the leading face 130 of the rotating cutter 34 causing the rubber particles to stretch. The material is elongated and exposed to a force beyond the point which the material can withstand, and it breaks.

Immediately after breaking, the material shrinks and becomes significantly reduced in size from its maximum elongated dimension, at which point some of the material particles are released from the gap 68. As noted above, the stationary cutter 28 and rotating cutter 34 have flattened cutting surfaces (leading faces 120 and 130), rather than knife edge blades (which would not stretch the rubber, but rather jam into it). In addition to this stretching, the rotating cutter 34 repeatedly strikes the material, which reduces the elastomeric bonding between the inner particles of the material, allowing material to be scraped off into thinner and thinner particulate matter. Additionally, the rotating cutter 34 liberates material by both a shearing action (repeated rubbing against the material, each time liberating a small amount in powder form) and by rubbing between the surfaces of the stationary cutter 28 and the rotating cutter 34 in gap 68, further breaking the elastomeric bond between small pieces. In addition, the large surface openings 78 (in the stationary cutter 28) and 84 (in the rotating cutter 34), create scissor-like closings, as shown in FIG. 6. The scissors angle 88 progressively becomes smaller and smaller, thus reducing the quantity of the material entering between the cutters 28 and 34.

Because of the tendency of the present invention not to jam, the rotational speed of the rotating shaft 22 can be kept constant and high speed. Typically, the granulating/grinding machines 10 of the present invention operate at between about 50 and 400 rpm, but the speed may be varied depending on the specific application. Thus the granulating/grinding machine 10 of the present invention efficiently processes materials that have caused problems in prior art machines.

Referring to FIG. 10, the gap 68 between the stationary cutter 28 and the rotating cutter 34 is determined by the thickness of the annular ring spacer 38 (which is generally the same as that of the central rotating spacer 44), and is made wide enough to leave the desired space between the rotating cutters 34 and the stationary cutters 28 so as to allow rotation of the rotating shaft 22 without friction and to allow for the thickness of the material particles in the particular processing phase. For most applications, the gap 68 ranges from about 0.10 mm to about 0.50 mm. In a preferred embodiment, the gap 68 is about 0.25 mm, often with a larger gap at the beginning of the grinding process when the particles are large, for example a 2 mm gap has been successfully employed. As the material passes further rearward into the processing section 46 of the granulating/grinding chamber 14 (FIG. 2), the action is repeated over and over, with the gap 68 eventually reaching about 0.25 mm. Progressively, the material particle size is reduced as more and more grinding takes place. In a preferred embodiment, fifteen stationary cutters 22 and fourteen rotating cutters 24 are employed (forming fourteen cutting units 32) in the following sequence: fixed, rotating, fixed, rotating . . . fixed. Other embodiments may use greater or lesser numbers depending upon the specific application. The cutting units 32 thus reduce the material into progressively finer and finer pieces, until it is at the desired consistency.

FIG. 10 shows one embodiment in which the gap 68 between the rotating cutter 34 and the stationary cutter 28 has a constant width and there are no slanted surfaces on edges of the teeth 48 of the rotating cutters 24 (rather, flat surfaces 46 are employed). FIG. 7 shows another embodiment in which fine grind rotating cutters, such as fine grind rotating cutter 86, are placed towards the rear of the granulating and grinding unit 12, and can have a different tooth edge shape, specifically beveled teeth 70. In this embodiment, the leading edge of each beveled tooth 70 of the fine grind rotating cutter 86 does not have exclusively flat surfaces (like flat surfaces 72) at right angles to each other, but rather has two types of edge surfaces: flat surfaces 72 and a slanted surface 74, at an angle 76 to beveled tooth 70, orientated such that the slanted surface 74 forms a face which approaches the incoming material. The slanted surface 74 urges and guides the material between the fine grind rotating cutter 86 and the stationary cutter 28. In this embodiment of the present invention the gap 68 can be as small as 0.10 mm because the fine grind rotating cutter 86 is a finer grinding tool, usually used during the final stages of the particle size reduction process and allows the small particles to be forced between the rotating and the stationary cutter in a more forceful way. The size of the angle 76 can vary depending upon the specific application between one and thirty-five or more degrees, but in a preferred embodiment about sixteen degrees has been found to work well. An improper angle could cause excessive axial load, causing the fine grind rotating cutter 86 to buckle or break causing extensive damage. It should be noted that beveled teeth can also be employed in any rotating cutter, such as those with three teeth (e.g., rotating cutter 34).

In this beveled tooth 70 embodiment of the present invention, the flat surface 72 acts like a grinder and the slanted surface 74 acts like an auger, and the rotating cutter (34 or 86) sucks the material into the gap 68 between the rotating cutter (34 or 86) and the stationary cutter 28, which then causes the rubber material to stretch and break. In still another aspect of the present invention, the stationary cutter 28 may have slanted teeth surfaces (not shown) identical to that of the fine grind rotating cutter 86, or both the rotating cutter 34 and the stationary cutter 28 may have such slanted teeth surfaces. Moreover, the teeth 48 of the rotating cutters 34 and the stationary cutters 28 may have yet another shape, for example a V-shape (not shown) where both edges of the teeth 48 have slanted surfaces.

Figure 11B:
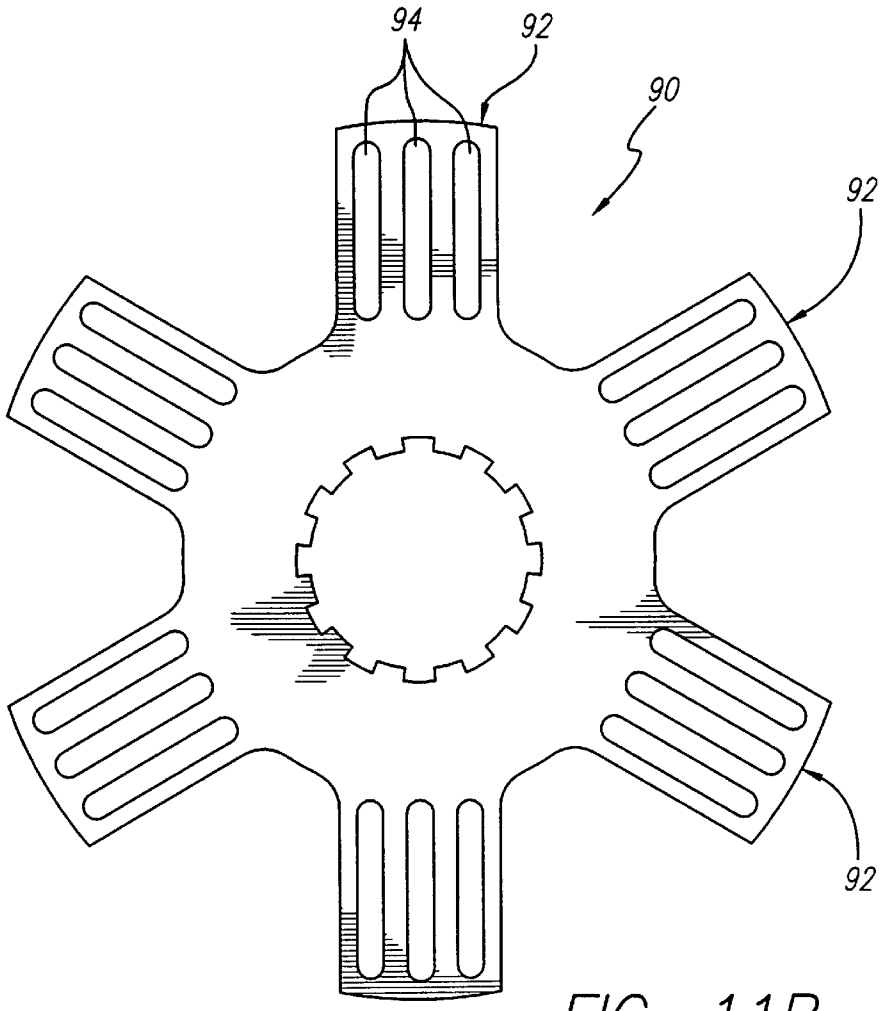
FIG. 11 is a top plan view and a side view of a final grind rotating cutter (90).
Figure 11A:
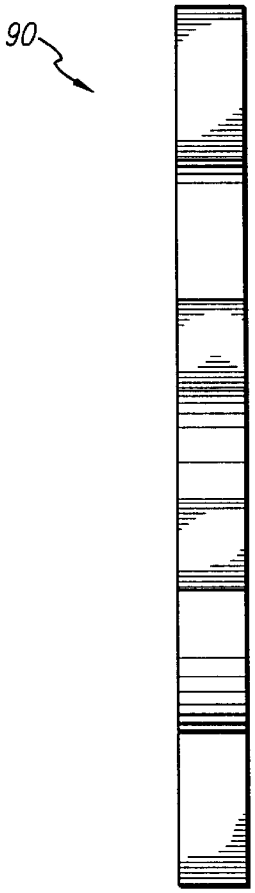
Figure 12:
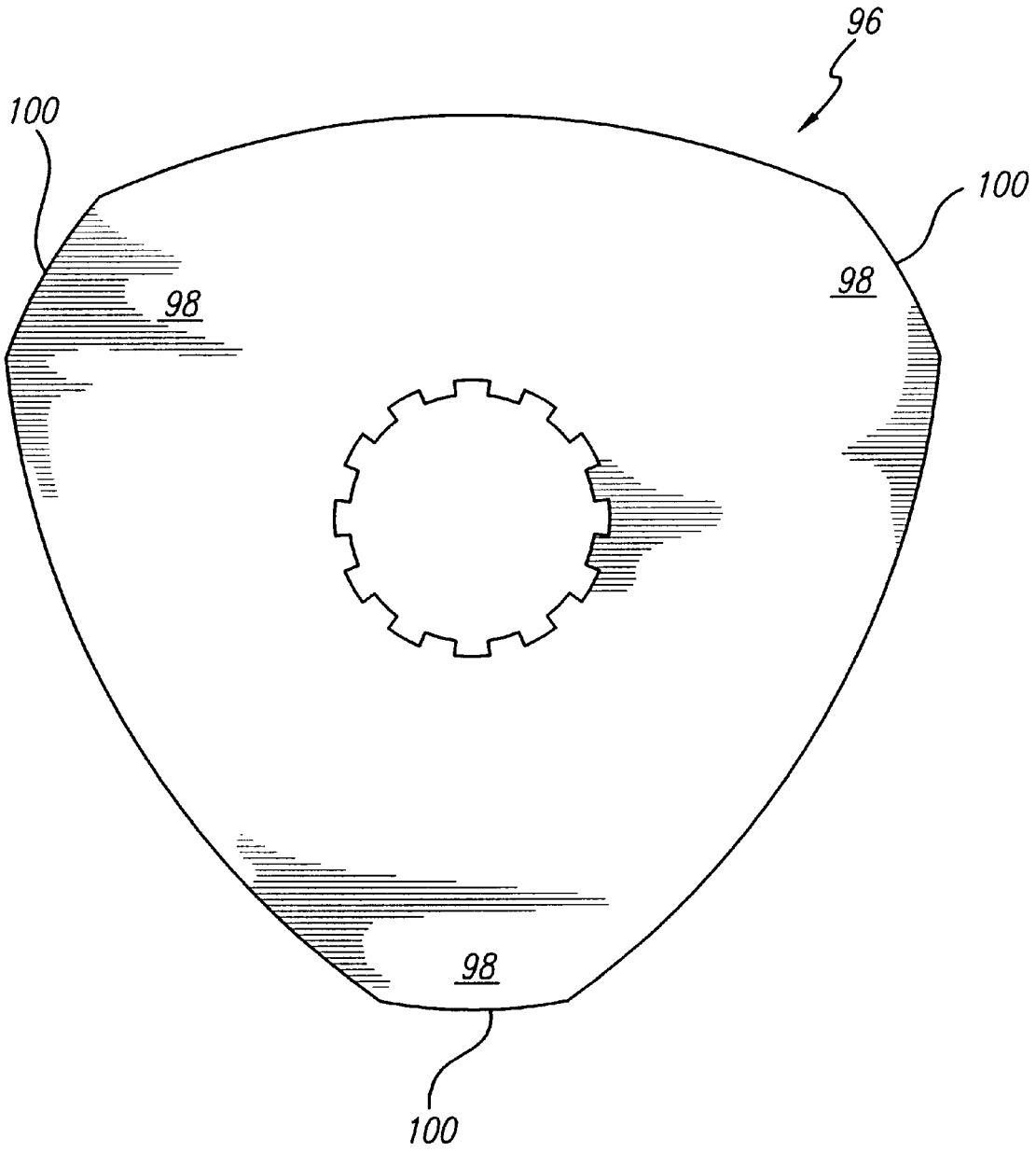
FIG. 12 is a top plan view and a side view of a triangular rotating cutter (96).

FIG. 11 shows a final grind rotating cutter 90, having six teeth 92 which may be used in an alternate embodiment. Each of the teeth 92 have three apertures 94. The apertures provide additional cutting surfaces, with each aperture providing a leading edge similar to flat surface 72 of the rotating cutters 34 and fine grind rotating cutters 86 (FIG. 7), as well as reducing the load on the electric motor 56. Typically the final grind rotating cutters 90 would be positioned rearward of the fine grind rotating cutters 86, near the rear of the processing section 46 (FIG. 2). FIG. 12 shows a triangular rotating cutter 96, which in the above described alternate embodiment, may be placed near the rear of the processing section 46 and serves three primary functions. First, it provides a moving barrier, preventing material from moving too quickly through the processing section 46 and thus not ground to the proper degree. Second, the triangular rotating cutters 96 provide additional grinding both by the action of each triangular tooth 98 rotating adjacent to a stationary cutter, such as stationary cutter 28 (FIG. 3) to impact, stretch and sheer off quantities of the material to be processed. Finally, the tips 100 of the teeth 98 compress the material against the wear protection sleeve 62, breaking down the material.

In yet another aspect of the present invention shown in FIGS. 1 and 7, the granulating/grinding machine 10 can have two or more processing units or barrels, for example granulating and grinding unit 12 and second granulating and grinding unit 64, perhaps with granulating and grinding unit 12 utilized for large material pieces and second granulating and grinding unit 64 for additional particle size reduction. In such an embodiment, all the rotating cutters 34 of the second granulating and grinding unit 64 could be equipped with such slanted teeth.

Referring to FIG. 2, the granulating/grinding chamber 14 of the present invention is preferably cooled, and that can be accomplished by water, air, liquid nitrogen, or oil. In a preferred embodiment, the cooling is accomplished by water which circulates through ducts, such as water jacket 140, within the granulating/grinding chamber 14 walls, and/or by adding water or other coolant to the material to be processed.

The present invention may be fabricated from any number of materials, however in a preferred embodiment it is made of metal, preferably steel, which can be either mild steel, high tensile steel, tool steel or modified steel (e.g., stainless steel). Because metal has the tendency to change dimensions when hot, the stationary cutters 22 and the rotating cutters 24 will increase in size during use. However, in the present invention, both the rotating cutters 34 and the stationary cutters 28 can increase in size inside the granulating/grinding chamber 14 without changing their relative position to each other, because all the parts are made from the same material and have the same relative increase in size, and the cutters are allowed to "float."

The granulating/grinding machine 10 of the present invention uses much less power than conventional grinding machines, due to the greater efficiency achieved by use of the above described granulating and grinding mechanism, rather than cutting with sharpened knife-like opposing blades. Furthermore, the use of blunt edged teeth 48 turning at high speed, reduces jamming and thus further reduces power requirements.

In operation, the user will activate the electric motor 56 and insert the material to be processed into the intake opening 16 of the granulating/grinding unit 12. The rotation of the intake auger 24 urges the material from the intake section 36 to the processing section 48. As described above, the material is granulated and ground into progressively smaller pieces by the cutting units 32 (which initially consist of a rotating cutter 34 and a stationary cutter 28, although cutting units 32 positioned near the discharge section 42 may include fine grind rotating cutters 86). The resulting granulated/ground material passes into the discharge section 46 where a discharge auger 26 urges the material to the exit opening 18 where it exits the granulating and grinding unit 12. If a finer grind is desired, the material may be transferred from the exit opening 18 of granulating and grinding unit 12 and enter the intake opening of second granulating and grinding unit 64 for further processing.

While the preferred embodiments have been described and illustrated, various modifications and substitutions may be made thereto without departing from the scope of the invention. Accordingly, it should be understood that the present invention has been described by way of illustration and not limitation.

What is claimed is:

1. A grinding/granulating device for reducing deformable material into smaller units, said device comprising:

a processing chamber for reducing said material into smaller units, the chamber having an inside wall with an intake side with an intake opening, and an exit side with an exit opening;

a rotating shaft passing through said processing chamber and connected to a motor means for rotating said shaft;

one or more stacked cutting units arranged along the grinding chamber, each cutting unit comprising:

at least one stationary cutter extending from the inside wall of the processing chamber, having at least one cutting tooth said cutting tooth having a flattened cutting surface, and defining an aperture cavity through which the rotating shaft passes;

at least one rotating cutter, fixedly attached to the rotating shaft and rotating with said shaft, having at least one cutting tooth, said cutting tooth, said cutting tooth having a flattened cutting surface and rotating adjacent to said at least one cutting tooth of the stationary cutter, to impact, stretch and sheer off quantities of said deformable material; and means for urging material to be ground from said intake opening to said plurality of cutting units;

wherein the material is reduced by the action of the rotating cutter rotating in proximity to the fixed cutter.

2. The device of claim 1 wherein the rotating cutter has three teeth.

3. The device of claim 1 wherein stationary cutter has three teeth.

4. The device of claim 1 wherein said at least one rotating cutter is located proximate to the intake side of the grinding chamber, and having at least three teeth, and said device further comprising a second rotating cutter, located proximate to the exit side of the grinding chamber and distant from the intake side, said second rotating cutter having more than three teeth.

5. The device of claim 4 wherein the second rotating cutter has six teeth.

6. The device of claim 1 wherein at least one of said one or more stacked cutting units further comprises one rotating cutter and two stationary cutters.

7. The device of claim 1 wherein at least one of said one or more stacked cutting units further comprises one stationary cutter and two rotating cutters.

8. The device of claim 1 wherein said means for urging material to be ground from said intake opening to said plurality of cutting units further comprises an intake auger.

9. The device of claim 8 further comprising a discharge auger for moving ground material particles to the exit opening.

10. The device of claim 1 wherein said cutting units further comprise:

a stationary annular spacer surrounding the rotating cutter and touching an adjacent stationary cutter, providing a gap between the stationary and the rotating cutter; and a central rotating spacer attached to the rotating shaft and adapted to fit inside the stationary cutter;

wherein material is forced past the stationary and then the rotating cutter.

11. The device of claim 10 wherein said stationary cutter, rotating cutter, annular spacer and central rotating spacer are made of the same material.

12. The device of claim 10 wherein said annular spacer and said central rotating spacer are sized and positioned such that the material is confined between an outer surface of the central rotating spacer and an inner surface of said annular spacer.

13. The device of claim 1 wherein said at least one rotating cutter revolves at a speed in the range of approximately 50–400 revolutions per minute.

14. The device of claim 1 wherein said at least one rotating cutter revolves at a speed in excess of 100 revolutions per minute.

15. The device of claim 1 further comprising a water jacket contained within the inside wall of the processing chamber;

said water jacket having an inflow duct and an outflow duct, and a pump, pumping water into the inflow duct;

wherein heat is dissipated from the grinding/granulating device by transference to the water.

16. A method for granulating/grinding elastic material comprising the following steps:

cutting the elastic material into appropriately sized pieces;

urging the pieces into a grinding chamber;

positioning a second blade having a flattened cutting surface adjacent to a first blade also having a flattened cutting surface;

rotating the second blade relative to the first blade;

moving the pieces past the first blade; and moving the pieces past the second blade, allowing the second blade to impact the material, stretch it and sheer off quantities of the material against the first blade.

17. The method of claim 16 further comprising the additional steps of:

positioning a fourth blade adjacent to a third blade;

rotating the fourth blade relative to the third blade;

after moving said pieces past the first and second blades, moving the pieces past the third blade; and moving the pieces past the fourth blade, allowing the fourth blade to impact the material, stretch it and sheer off quantities of the material against the third blade, creating a finer resulting product then produced by the first and second blades.

18. The method of claim 17 further comprising the additional steps of: moving the resulting sheered off pieces past additional sets of two adjacent blades, one rotating relative to the other, creating a progressively finer resulting product than produced by the first and second fixed and rotating blades.

* * * * *